US011650028B2

(12) United States Patent
Howell et al.

(10) Patent No.: US 11,650,028 B2
(45) **Date of Patent: *May 16, 2023**

(54) DEPLOYABLE ORIGAMI-INSPIRED BARRIERS

(71) Applicant: BRIGHAM YOUNG UNIVERSITY, Provo, UT (US)

(72) Inventors: Larry L. Howell, Provo, UT (US); Spencer P. Magleby, Provo, UT (US); David C. Morgan, Provo, UT (US); Terri Bateman, Provo, UT (US); Jeffrey E. Niven, Provo, UT (US); Alex Avila, Provo, UT (US); Erica Crampton, Provo, UT (US); Kyler Tolman, Provo, UT (US); Jacob Greenwood, Provo, UT (US); Peter Schleede, Provo, UT (US)

(73) Assignee: BRIGHAM YOUNG UNIVERSITY, Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/539,436

(22) Filed: Dec. 1, 2021

(65) Prior Publication Data

US 2022/0090882 A1 Mar. 24, 2022

Related U.S. Application Data

(63) Continuation of application No. 16/330,141, filed as application No. PCT/US2017/050329 on Sep. 6, 2017, now Pat. No. 11,215,428.

(Continued)

(51) Int. Cl.

*F41H 5/06* (2006.01)
*E01F 13/02* (2006.01)

(Continued)

(52) U.S. Cl.

CPC ..... *F41H 5/06* (2013.01); *E01F 13/02* (2013.01); *E06B 9/06* (2013.01); *F41H 5/013* (2013.01);

(Continued)

(58) Field of Classification Search

CPC ... F41H 5/06; F41H 5/013; F41H 5/04; F41H 5/24; E01F 13/02; E06B 9/06; E06B 2009/007

See application file for complete search history.

(56) References Cited

U.S. PATENT DOCUMENTS 1,273,371 A 7/1918 Hudziak
1,649,996 A 11/1927 Toth (Continued)

FOREIGN PATENT DOCUMENTS

WO 2009151706 A1 12/2009
WO 2018048940 A1 3/2018

OTHER PUBLICATIONS

International Search Report and Written Opinion from International Application No. PCT/US2017/050329 dated Dec. 27, 2017.

(Continued)

*Primary Examiner* — Joshua E Freeman
(74) *Attorney, Agent, or Firm* — Dorsey & Whitney LLP

(57) ABSTRACT

An example barrier can be switchable between an at least partially collapsed state and at least partially expanded state (e.g., a deployed state). For example, the barrier can be formed from a continuous sheet and a plurality of rigid sections (e.g., rigid panels) attached or incorporated into the continuous sheet. The barrier can also include a plurality of hinges, such as hinge lines, between the panels that are formed from the continuous sheet. The hinges enable the barrier to be rigid foldable (e.g., the hinges can fold and (Continued)

unfold while the rigid sections remain stiff and rigid) between the expanded and collapsed states.

20 Claims, 7 Drawing Sheets

Related U.S. Application Data

(60) Provisional application No. 62/456,275, filed on Feb. 8, 2017, provisional application No. 62/409,186, filed on Oct. 17, 2016, provisional application No. 62/384,398, filed on Sep. 7, 2016.

(51) Int. Cl.

| | |
|---|---|
| ***E06B 9/06*** | (2006.01) |
| ***F41H 5/013*** | (2006.01) |
| ***F41H 5/04*** | (2006.01) |
| ***F41H 5/24*** | (2006.01) |
| *E06B 9/00* | (2006.01) |

(52) U.S. Cl.
CPC ..... *F41H 5/04* (2013.01); *F41H 5/24* (2013.01); *E06B 2009/007* (2013.01)

(56) References Cited

U.S. PATENT DOCUMENTS 2,020,702 A 11/1935 Russell
2,109,831 A 3/1938 Szalkay
3,979,861 A * 9/1976 Fromme ..... E06B 3/94 52/71
4,412,495 A 11/1983 Sankar
4,949,490 A * 8/1990 Miller ..... G09F 15/0068 160/135
5,293,807 A 3/1994 Hajdu
5,377,577 A 1/1995 Bounkong et al.
5,392,686 A * 2/1995 Sankar ..... F41H 5/08 109/49.5
6,161,462 A * 12/2000 Michaelson ..... F41H 5/06 102/303
6,581,505 B1 6/2003 Levell
6,807,890 B1 * 10/2004 Fuqua ..... F41H 5/08 89/36.02
6,907,811 B2 * 6/2005 White ..... F41H 5/06 109/49.5
7,424,844 B2 9/2008 Carter
7,730,925 B1 * 6/2010 Pereira ..... E06B 9/262 160/84.04
7,891,283 B2 * 2/2011 Kleniatis ..... F41H 5/08 89/36.09
7,980,166 B1 * 7/2011 Fuqua ..... F41H 5/24 89/36.07
8,015,910 B1 * 9/2011 Fuqua ..... F41H 5/14 89/36.09
8,176,830 B1 5/2012 Tan
8,276,498 B1 10/2012 Hannibal et al.
8,418,595 B1 * 4/2013 Saucedo ..... F41H 5/26 89/36.07
8,646,372 B1 * 2/2014 Lee ..... F41H 5/08 89/36.07
9,512,618 B2 * 12/2016 Lang ..... F24S 20/50
9,885,539 B2 * 2/2018 Spransy ..... F41C 27/04
10,351,195 B1 * 7/2019 Schieffelin ..... B62J 9/20
10,677,566 B2 * 6/2020 Dantzer ..... F41H 5/04
2002/0184936 A1 * 12/2002 Gitlin ..... B21D 5/00 72/379.2
2007/0193441 A1 * 8/2007 Carter ..... F41H 5/08 89/36.07
2008/0200095 A1 * 8/2008 Guenette ..... A63H 33/16 446/488
2008/0283205 A1 * 11/2008 Zimmer ..... A47H 23/04 160/330
2009/0235814 A1 * 9/2009 Cashin ..... B32B 5/024 89/36.02
2009/0294077 A1 * 12/2009 Zimmer ..... A47H 13/04 160/168.1 R
2012/0186435 A1 7/2012 Garcia
2013/0284002 A1 * 10/2013 White ..... F41H 5/0407 89/36.01
2015/0059990 A1 * 3/2015 Adrain ..... F41H 5/0457 160/10
2016/0061569 A1 * 3/2016 Fernandez ..... F41H 5/04 89/36.02
2016/0209181 A1 * 7/2016 Adrain ..... E06B 9/386
2016/0272359 A1 * 9/2016 Kim ..... A63H 33/16
2019/0085517 A1 * 3/2019 Thota ..... E01F 8/0023
2019/0113312 A1 * 4/2019 Adrain ..... B60J 1/2088
2019/0381755 A1 * 12/2019 Tachi ..... B31B 50/006
2020/0023257 A1 * 1/2020 Speed ..... A63B 1/00
2020/0037771 A1 * 2/2020 Ketels ..... A47B 23/002
2020/0393217 A1 * 12/2020 Adrain ..... B60J 1/2088

OTHER PUBLICATIONS

Non-Final Office Action for U.S. Appl. No. 16/330,141 dated May 12, 2021.
Non-Final Office Action for U.S. Appl. No. 16/663,903 dated Sep. 15, 2021.
Notice of Allowance for U.S. Appl. No. 16/330,141 dated Sep. 2, 2021.
U.S. Appl. No. 16/330,141, filed Mar. 4, 2019.
U.S. Appl. No. 16/663,903, filed Oct. 25, 2019.
U.S. Appl. No. 62/384,398, filed Sep. 7, 2016.
U.S. Appl. No. 62/409,186, filed Oct. 17, 2016.
U.S. Appl. No. 62/456,275, filed Feb. 8, 2017.
Corrected Notice of Allowance for U.S. Appl. No. 16/330,141 dated Dec. 9, 2021.
Issue Notification for U.S. Appl. No. 16/330,141 dated Dec. 15, 2021.
Issue Notification for U.S. Appl. No. 16/663,903 dated Sep. 7, 2022.
Notice of Allowance for U.S. Appl. No. 16/663,903 dated Feb. 18, 2022.
Notice of Allowance for U.S. Appl. No. 16/663,903 dated May 27, 2022.

* cited by examiner

DEPLOYABLE ORIGAMI-INSPIRED BARRIERS

CROSS-REFERENCE TO RELATED APPLICATIONS

This application is a continuation application of U.S. patent application Ser. No. 16/330,141 filed on Mar. 4, 2019; which claims priority to PCT Application No. PCT/US2017/050329 (published as International Application No. WO 2018/048940) filed on Sep. 6, 2017; which claim priority to U.S. Provisional Patent Application No. 62/384,398 filed on 7 Sep. 2016; U.S. Provisional Patent Application No. 62/409,186 filed on 17 Oct. 2016; and U.S. Provisional Patent Application No. 62/456,275 filed on 8 Feb. 2017. The disclosure of each of the foregoing applications is incorporated herein, in its entirety, by this reference.

STATEMENT OF GOVERNMENT INTEREST

This invention was made with government support under contract EFRI-ODISSEI-1240417 awarded by the National Science Foundation and Air Force Office of Scientific Research. The government has certain rights in the invention.

BACKGROUND

A barrier is an object that prohibits or impedes the progress of another object. Acoustic barriers prevent sound from traveling through them. A flood barrier stops water from flowing past it. A radiation barrier, such as a lead blanket used at the dentist's office, prevents harmful x-rays from damaging your body.

One common problem with barriers is that they are often large and hard to transport. As such, there is a need for barriers that can be stored small and quickly expanded (e.g., deployed) to cover a large area. Current solutions to this problem include folding barriers, barriers that roll up, and modular panel barriers. While these barriers solve the problem of size, they also introduce other challenges, such as increased degrees of freedom, slow expansion, manual assembly, and possible cuts, holes, and gaps in the barrier.

Despite the availability of a number of different barriers, manufacturers and users of barriers continue to seek new and improved barriers.

SUMMARY

Embodiments disclosed herein are directed to barriers inspired by thick origami, methods of making such barriers, and methods of using such barriers. In an embodiment, the barrier can be switchable between a collapsed state and a deployed state. For example, the barrier can be formed from a continuous sheet and a plurality of rigid sections (e.g., panels) attached or incorporated into the continuous sheet. The barrier can also include a plurality of hinges between the panels (e.g., formed from the continuous sheet) that allow the barrier to be rigid foldable (e.g., motion can occur if deformation in the creases between the rigid sections only and the panels can be stiff and rigid) between the deployed and collapsed states.

In an embodiment, a barrier is disclosed. The barrier includes a continuous sheet. The barrier also includes a plurality of rigid sections attached to or incorporated into the continuous sheet. Additionally, the barrier includes a plurality of hinges between the plurality of rigid sections. The plurality of hinges are formed from portions of the continuous sheet. The barrier is configured to be switchable between an at least partially collapsed state and an at least partially expanded state.

In an embodiment, a method to make a barrier is disclosed. The method includes providing a continuous sheet. The method also includes defining a plurality of rigid sections on the continuous sheet. The method further includes forming a plurality of hinges from portions of the continuous sheet that are disposed between the plurality of rigid sections.

In an embodiment, method to deploy a barrier is disclosed. The method includes providing a barrier that is in an at least partially collapsed state. The barrier includes a continuous sheet, a plurality of rigid sections attached to or incorporated into the continuous sheet, and a plurality of hinges formed from the continuous sheet that are disposed between the plurality of rigid sections. The method also includes switching the barrier from the at least partially collapsed state to an at least partially expanded state by unfolding the plurality of hinges. The barrier in the at least one expanded state exhibits at least one of a length, width, or thickness that is greater than the barrier in the at least partially collapsed state.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Figure 1A:
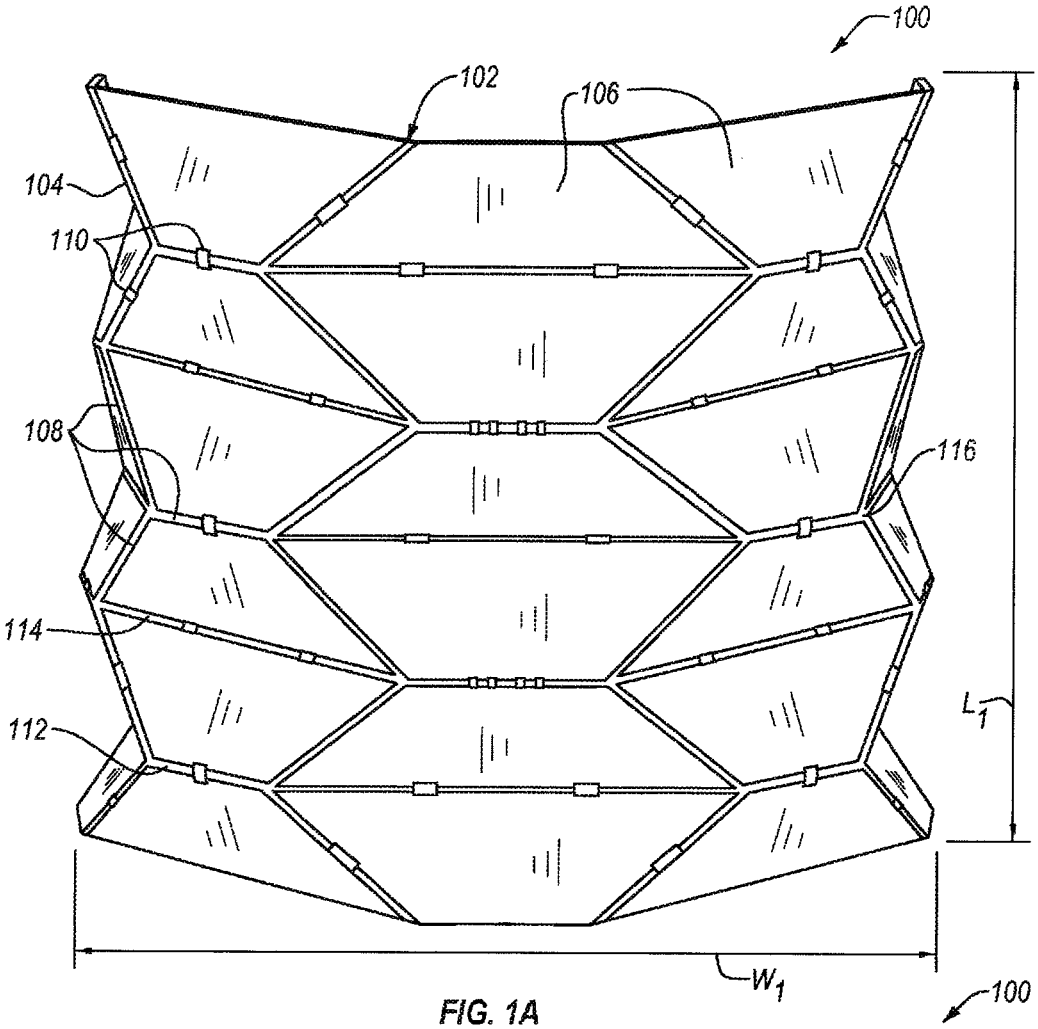
FIG. 1A is a front view of a barrier in an at least partially expanded state, according to an embodiment.

Embodiments disclosed herein are directed to barriers inspired by thick origami, methods of making such barriers, and methods of using such barriers. In an embodiment, the barrier can be switchable between an at least partially collapsed state and at least partially expanded state (e.g., a deployed state). For example, the barrier can be formed from a continuous sheet and a plurality of rigid sections (e.g., rigid panels) attached to or incorporated into the continuous sheet. The barrier can also include a plurality of hinges, such as hinge lines, between the panels that are formed from the continuous sheet. The hinges allow the barrier to be rigid foldable (e.g., the hinges can fold and unfold while the rigid sections remain stiff and rigid) between the expanded and collapsed states.

The continuous sheet (e.g., an unbroken surface of the barriers) can be split into portions thereof that are proximate to or include the rigid sections, and into other portions (e.g., the gaps between rigid sections) that form the hinges. The barrier is foldable along the hinges to switch between its expanded state to a smaller collapsed state. The barrier can include at least one vertex where multiple hinges converge together. The rigid sections and the hinges can create a tessellated mechanism that can, but is not limited to, one or more of dictating the degrees of freedom, control the folding and unfolding process, store energy to help expand or collapse the barrier, or maintain the barrier in certain states.

In a typical use of the barrier, the barrier can be stored and transported in its collapsed state. The barrier can include wheels, straps, and/or handles that are configured to facilitate transportation. For example, the barrier can be carried or towed like luggage or worn on the back like a backpack. When an operator of the barrier reaches a desired destination, the operator can place the barrier on a support surface (e.g., ground or floor) and expand (e.g., deploy) the barrier. In an embodiment, the barrier can be expanded automatically using one or more of compressed air, springs, telescoping poles, or braces. In another embodiment, the barrier can be expanded manually. The expansion of the barrier can be limited by the telescoping poles, the braces, a rope or some other fabric that reaches a maximum length, thus stopping the expansion of the barrier. Once the barrier is at its desired expanded state, the barrier can be locked in place using braces (e.g., locking hinges, over-center latches, or telescoping poles), or springs, or the barrier can maintain its shape because of friction in the hinges or from the friction between barrier and the support surface.

In an embodiment, the barrier can exhibit a generally "C" shape that provides front and flank protection when expanded that makes the barrier self-standing, but other configurations or support methods can be used. The barrier can have multiple configurations making it more versatile. For example, if the barrier needs to be set-up in a hallway, the sides can be folded in or, if the user wanted to use it to cover a wall, the barrier can be made completely flat and propped or attached to the wall. Once the barrier is no longer needed, the barrier can be folded back to its collapsed state which exhibits a compact size relative to the barrier in the expanded state. The barrier can be held in its collapsed state by straps, magnets, clasps, bag, or other suitable device.

FIG. 1A is a front view of a barrier 100 in an at least partially expanded state, according to an embodiment. The barrier 100 includes a continuous sheet 102 that includes at least two exterior surfaces 104. The barrier 100 can also include a plurality of rigid sections 106 that are attached to at least one of the exterior surfaces 104 of the continuous sheet 102 (as shown), disposed in the continuous sheet 102 (see FIG. 4D-4E), or otherwise incorporated into the continuous sheet 102. The rigid sections 106 can define gaps therebetween. The portion of the continuous sheet 102 that is adjacent to the gaps can form hinges 108 that are configured to fold and unfold, such as fold and unfold without creasing. Allowing the hinges 108 to fold and unfold can switch the barrier 100 between the expanded state (FIG. 1A) and the collapsed state (FIG. 1C). In an embodiment, the barrier 100 can optionally include a plurality of springs 110 that ensure correct deployment of the barrier 100 and are configured to maintain the barrier 100 in the expanded state.

As shown in FIG. 1A, the barrier 100 exhibits a relatively large exposed area when the barrier 100 is in the expanded state. For example, the barrier 100 can cover an area that is about 2 feet to about 10 feet by about 2 feet to about 10 feet, such as an area that is about 4 feet by about 6 feet. For instance, the barrier 100 can exhibit a length $L_1$ of about 3.5 feet and a perimeter of about 5.5 feet when in the expanded state. In some embodiments, the barrier 100 is self-standing. In another example, the barrier 100 can exhibit a weight that is less than about 120 lbs., such as less than about 100 lbs., less than about 90 lbs., less than about 75 lbs., less than about 60 lbs., or less than about 50 lbs. Additionally, the barrier 100 can be configured to switch from the collapsed state to the expanded state in less than about 20 seconds by a single individual, such as in less than about 15 seconds, or less than about 10 seconds. In other words, the barrier 100 can be expanded easily and quickly.

In an embodiment, the continuous sheet 102 of the barrier 100 can be made from a single sheet that may be uncut. Forming the continuous sheet 102 from a single uncut sheet can allow the barrier 100 to exhibit the folding characteristics of origami and prevents holes in the barrier 100 through which items and energy can pass. As previously discussed, portions of the continuous sheet 102 that are between the rigid sections 106 can form the hinges 108 of the barrier 100, thereby allowing the barrier 100 to be foldable (e.g., switch between the expanded and collapsed state) without creasing. The barrier 100, including the continuous sheet 102, can exhibit improved barrier properties than a substantially similar barrier that includes a discontinuous sheet. For example, forming the continuous sheet 102 from bulletproof material can create bulletproof hinges, can avoid the uncertain ballistic behavior of traditional hinges, and can ensure that the ballistic rating would be at the least rated to the ballistic level of the continuous sheet 102. In another example, forming the continuous sheet 102 from acoustic absorbing material can substantially prevent acoustic energy from passing through the hinges 108.

The continuous sheet 102 can be formed of any suitable compliant material. For example, the continuous sheet 102 can include a material that exhibits excellent ballistic properties, acoustic absorbing properties, a good yield or shear strength, good abrasion resistance, good resistance to sunlight (e.g., ultra-violet light resistance), good water resistance (e.g., waterproof), etc. In another example, the continuous sheet 102 can include a material that resists creasing. In another example, the continuous sheet 102 can include one or more of ballistic nylon, Kevlar®, ultra-high-molecular-weight polyethylene fabric, or another suitable material.

In an embodiment, the continuous sheet 102 can be formed from a plurality of layers (as shown in FIGS. 4B-4E), such as a plurality of layers of ballistic fabric. At least one (e.g., each) of the plurality of layers can be a continuous layer. In an example, the barrier 100 can be formed from 2 layers to 5 layers, 4 layers to 7 layers, 5 layers to 10 layers, 7 layers to 15 layers, 10 layers to 20 layers, 15 layers to 25 layers, 20 layers to 40 layers, 30 layers to 50 layers, or more than 50 layers. In an example, the continuous sheet 102 can be formed from a plurality of layers that are substantially the same. In another example, the continuous sheet 102 can be formed from a plurality of different layers. In such an example, the layers that are different can exhibit at least one of a material composition, porosity, structure (e.g., a fibrous structure vs. non-porous film structure), or thickness that is different. It is noted that the continuous sheet 102 can be formed from a plurality of layers regardless of the material used to form the continuous sheet 102.

In an embodiment, the continuous sheet 102 can exhibit a thickness that is negligible (e.g., greater than 0 mm to about 0.75 mm, greater than about 0 to about 1.5 mm) or non-negligible (e.g., greater than about 0.75 mm or greater than about 1.5 mm). For example, the continuous sheet 102 can exhibit a thickness that is less than about 25 mm, greater than 0 mm to about 12.5 mm, about 2.5 mm to about 6 mm, about 5 mm to about 13 mm, about 6 mm to about 19 mm, greater than about 13 mm, or about 13 mm to about 25 mm. Increasing the thickness of the continuous sheet 102 can improve the barrier properties of the barrier 100. For example, increasing the thickness of the continuous sheet 102 can increase the ballistic properties, increase acoustic barrier properties, increase fluid barrier properties (e.g., decrease a water permeation rate), decrease a heat permeation rate, increase opaqueness, increase impact resistance, etc. of the barrier 100. However, increasing the thickness of the continuous sheet 102 can increase the weight of the barrier 100 thereby making it harder to transport and operate. Additionally, as will be discussed in more detail with regards to FIGS. 3A-3C, increasing the thickness of the continuous sheet 102 can increase the complexity of the hinges 108.

The configuration of the hinges 108 can depend on the number of layers used to form the continuous sheet 102 and/or the thickness of the continuous sheet 102. For example, increasing number of layers and/or thickness of the continuous sheet 102 can increase the distance between the rigid panels 106, require the use of thick membrane folds (e.g., shown in FIGS. 3A-3C), etc.

In an embodiment (not shown), the barrier 100 can be formed form a discontinuous sheet. In such an embodiment, the hinges 108 can be formed using traditional hinges, such as a butt hinge, a T-hinge, a strap hinge, etc. The traditional hinges can be strengthened or covered by the continuous sheet 102 or another sheet, thereby preventing projectiles, energy, or other material from passing through the hinge area.

The rigid sections 106 perform several functions for the barrier 100. For example, the rigid sections 106 can be configured to resist deformation (e.g., resist folding and unfolding). The ability of the rigid sections 106 to resist deformation can facilitate controllably switching the barrier 100 between the collapsed and expanded states since the movement of the barrier 100 is restricted (e.g., prevents the formation of new hinges). Additionally, the ability of the rigid section 106 to resist deformation can make it easier to maintain the barrier 100 in the expanded state. In another example, the rigid sections 106 can improve the ballistic properties, acoustic barrier properties, etc. of the barrier 100 compared to a substantially similar barrier that does not include the rigid sections 106.

In an embodiment, the rigid sections 106 can include rigid panels (e.g., rigid material) that are distinct from the continuous sheet 102. As shown in FIG. 1A, the rigid panels can be attached to at least one of the exterior surfaces 104 of the continuous sheet 102. The rigid panels can be made from any rigid material, such as a material with ballistic properties or a light weight material. For example, the rigid panels can be formed from a light weight composite of aluminum and polyethylene (e.g., Dibond®), a fiberglass composite (e.g., Garolite), carbon fiber, magnesium alloys, aluminum alloys, silicon carbide, aluminum oxide, steel, titanium, ultra-high molecular weight polyethylene, synthetic spider silk, metal composite foams, other suitable ceramics, other suitable polymers, other suitable composites, or combinations thereof. For example, if the barrier 100 is a ballistic barrier, the panels can be formed from Garolite or carbon fiber because these materials are light weight, bullet-resistant, rigid, and inexpensive.

The rigid panels of the rigid sections 106 can be attached to the continuous sheet 102 using any suitable method. For example, the panels of the rigid sections 106 can be attached to the continuous sheet 102 by sewing, gluing, melting, bolting, pocketing, or any combination thereof. Such methods of attachment can minimize shearing between the layers of the continuous sheet 102 and the rigid panels, prevent bending of the rigid panels, and may not introduce weak points in the barrier 100. For example, a sharpened bolt can split a weave of the continuous sheet 102 fairly easily and attach the rigid panels snugly to the continuous sheet 102. However, using bolts to attach the rigid panels to the continuous sheet 102 can damage the continuous sheet 102.

In an embodiment, the rigid sections 106 can include rigid panels disposed in the continuous sheet 102. For example, the panels can be placed in the middle of the continuous sheet 102. For instance, the continuous sheet 102 can be formed from a plurality of layers and the panel can be placed between two of the layers. The rigid panels that are disposed in the continuous sheet 102 can include any of the rigid panels disclosed herein. The rigid panels can be maintained in a selected portion of the continuous sheet 102 using any suitable method, such as by sewing, gluing, melting, bolting, pocketing, or any combination thereof.

In an embodiment, the rigid sections 106 can include portions of the continuous sheet 102 that are reinforced to form the rigid sections 106. For instance, reinforcing the continuous sheet 102 can cause the continuous sheet 102 to resist folding. In an example, the continuous sheet 102 can be reinforced by attaching or disposing any of the rigid panels disclosed herein to or in the continuous sheet 102. In another example, the continuous sheet 102 can be reinforced by laminating at least one thermoplastic to the continuous sheet 102. In another example, the continuous sheet 102 can be reinforced by impregnating the continuous sheet 102 with an epoxy, resin, or other hardener (collectively referred to as "hardener"). In such an example, the rigid sections 106 can be formed by using the continuous sheet 102 as the matrix and then adding the hardener to harden selected regions of the continuous sheet 102. Heat and pressure can be applied to the continuous sheet 102 and the hardener to facilitate hardening of the hardener. A mask (e.g., rubber that would remain attached to the barrier 100) can be used to selectively cure the hardener. In another example, the continuous sheet 102 can be reinforced by sewing a plurality of stiches in the continuous sheet 102. The stiches can limit movement between the plurality of layers of the continuous sheet 102 thereby forming the rigid sections 106. These methods of creating the rigid sections 106 are not mutually exclusive and can be combined.

In an embodiment, the rigid sections 106 (e.g., rigid panels) can exhibit a thickness that is greater than about 0.8 mm, such as in ranges of about 0.8 mm to about 25 mm, about 0.8 mm to about 3 mm, about 1.6 mm to about 6.4 mm, about 1.6 mm to about 13 mm, or about 9.5 mm to about 25 mm. It is noted that the thickness of the rigid sections 106 can depend on the material or method used to form the rigid sections 106. As such, in some embodiments, the thickness of the rigid section 106 can be less than about 0.8 mm or greater than 25 mm. In an embodiment, the rigid sections 106 can include a surface that is flat, exhibits a non-flat shape (e.g., a concave or convex shape), includes one or more protrusion extending therefrom, or includes one or more recesses extending inwardly therefrom.

In an embodiment, the rigid sections 106 can be configured to limit the degrees of freedom of the barrier 100. For example, the rigid sections 106 can be configured to limit the barrier 100 to a single degree of freedom. Additionally, the thickness of the rigid sections 106 can be used to create interference. For example, the thickness of the rigid sections 106 can be equivalent of placing hinges on certain sides of the thick material so as to have the thickness interfere or restrict the movement of the hinges (e.g., most doors only swing one direction because hinges are placed on the valley side of the door and the thickness of the door and door frame prevent the door from swinging the other direction). As such, the thickness of the rigid sections 106 can limit degrees of freedom and can determine the available configurations of the barrier 100, thereby allowing more rapid set up and take down of the barrier 100.

In an embodiment, the rigid sections 106 can be made to at least partially overlap the hinges 108 to prevent the hinges 108 from being a weak point of the barrier 100. In an embodiment, the rigid sections 106 can include multiple layers of rigid panels 106 (e.g., rigid panels 106) on one or both sides of the continuous sheet 102.

Each of the hinges 108 includes a mountain side 112 that forms a generally convex shape and a valley side 114 that opposes the mountain side 112. Each of the hinges 108 can also form hinge lines that intersect with each other at least one vertex 116. As will be discussed in more detail below, the mountain side 112 of the hinges 108, the valley side 114 of the hinges 108, and how the hinges 108 intersect at the vertex 116 can be configured to bias the hinges 108 to bend in certain directions and to improve the stability of the barrier 100 when the barrier 100 is in the expanded configuration.

In an embodiment, the barrier 100 can include a plurality of springs 110 that are coupled to one or more components of the barrier 100. For example, at least some of the springs 110 can be coupled to the rigid sections 106 of the barrier 100 and can span across the hinges 108. In another embodiment, the barrier 100 does not include the springs 110.

The springs 110 can be configured to make the barrier 100 stable when the barrier 100 is in the expanded state and to provide spring-assisted actuation (e.g., easier switching between the expanded and collapsed states). For example, the springs 110 can apply a force across the hinges 108 that is configured to cause the hinges 108 to unfold. Such springs 110 can support at least a portion of the mass of the barrier 100. For instance, springs 110 that support at least a portion of the mass of the barrier 100 can automatically cause the barrier 100 to switch from the collapsed state to the expanded state or reduce the force required to manually switch the barrier 100 from the collapsed state to the expanded state. In another instance, the springs 110 can support enough of the mass of the barrier 100 that the barrier 100 remains in the expanded state. In another example, the springs 110 can be configured to prevent the barrier 100 from folding in the wrong direction. For instance, the springs 110 can bias the hinges 108 to fold in a selected directions.

In some embodiments, the springs 110 can be compression springs, leaf springs, torsional springs, resilient material (e.g., an elastomer), other suitable biasing elements, or any combination thereof. For example, the springs 110 can include steel springs. Alternatively or additionally, the springs 110 can be replaced with air cylinders, solenoids, motors, shape memory alloy actuators, other suitable actuators, or combinations thereof.

Figure 1B:
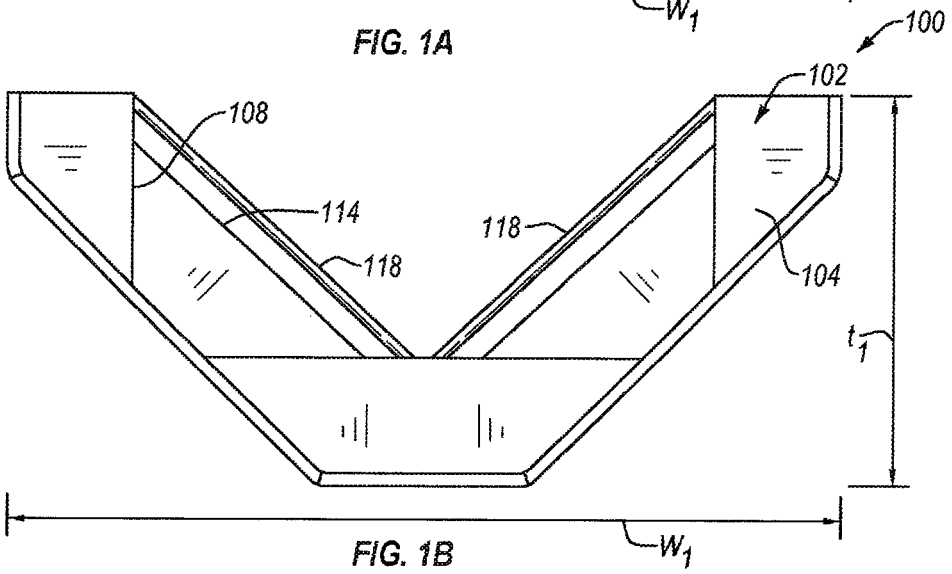
FIG. 1B is a top view of the barrier shown in FIG. 1A while the barrier is in the at least partially expanded state, according to an embodiment.
Figure 1C:
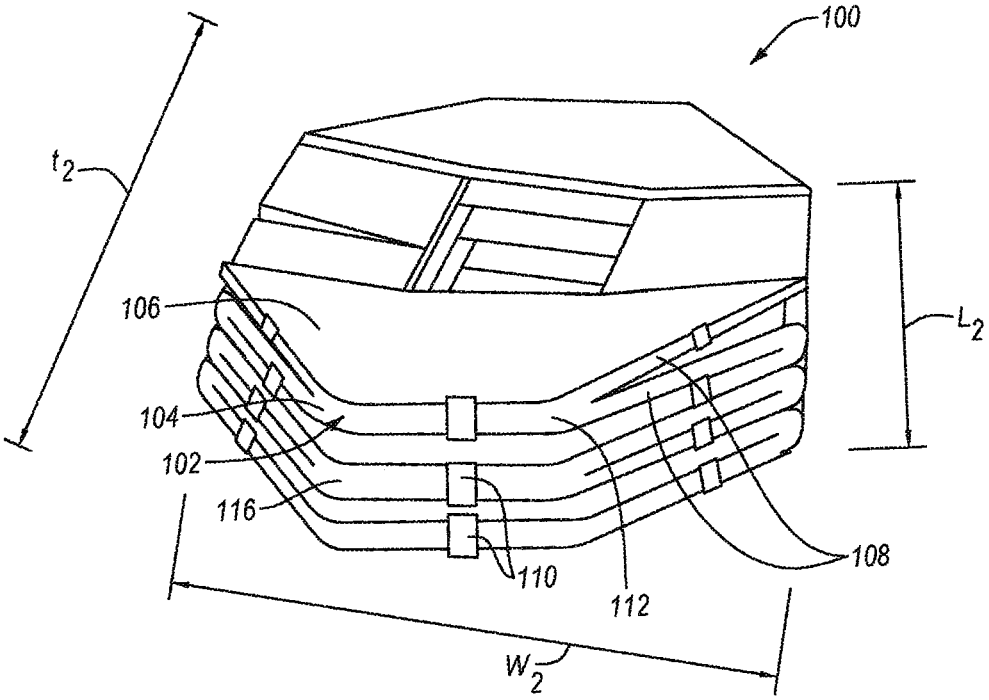
FIG. 1C is an isometric view of the barrier of FIGS. 1A-1B in the at least partially collapsed configuration, according to an embodiment.

FIG. 1B is a top view of the barrier 100 shown in FIG. 1A while the barrier 100 is in the at least partially expanded state, according to an embodiment. As shown in FIG. 1B, the barrier 100 can include at least one brace 118. The brace 118 can be configured to keep the barrier 100 in the expanded state when the brace 118 is activated (e.g., when the brace 118 is extended). For example, the brace 118 can add at least one compressive member to the barrier 100 for support.

In an embodiment, the brace 118 can include at least one telescoping pole that holds the barrier 100 in its expanded state. The telescoping poles can prevent gravity from pulling the barrier 100 into its collapsed state. For instance, the telescoping poles can expand from 25 in. to 36 in., allowing sufficient internal overlap to prevent bending and releasing, thereby allowing the barrier 100 to remain expanded. In another example, the barrier 100 can include air cylinders, solenoids, motors, shape memory alloys, light or temperature sensitive materials, leaf spring, other suitable braces, or combinations thereof instead of or in conjunction with the brace 118.

The barrier 100 is configured to be self-standing when the barrier 100 is in the expanded state. The barrier 100 can exhibit any shape that allows that barrier 100 to be self-standing. For example, the barrier 100 can exhibit a shape that includes at least one flat surface supported by at least one beam or another flat surface that extends from the flat surface towards a support surface. In such an example, the barrier 100 can form an A-frame. In another example, the barrier 100 can exhibit a shape that includes at least two flat surfaces that extend at an angle relative to each other, such as a generally V-shape, generally L-shape, or a generally W-shape. In another example, as shown in FIG. 1C, the barrier 100 can exhibit a curved shape, such as a generally C-shape, a generally O-shape, or a generally J-shape. In another example, the barrier 100 can exhibit a shape that offers protection from multiple angles (e.g., from a front and flank direction), such as a generally V-shape or a generally C-shape.

In an embodiment, the barrier 100 can include one or more additional components (not shown) that facilitate the operation of the barrier 100. For example, the barrier 100 can have lights attached to a front of the barrier 100. In another example, the barrier 100 can also have supports attached to the sides or top thereof upon which a gun can rest. In another example, the barrier 100 can have a clear section or define a gap so a user can see through it. In another example, the barrier 100 can have handholds, straps, wheels, or another device that facilitates movement of the barrier 100. In another example, the barrier 100 can include pockets, such as pockets sewn into the continuous sheet 102 and or formed in the rigid sections 106.

The barrier 100 may be unwieldy and hard to store when the barrier 100 is in the expanded state. As such, the barrier 100 is switchable between the expanded state and an at least partially collapsed state. FIG. 1C is an isometric view of the barrier 100 of FIGS. 1A-1B in the at least partially collapsed configuration, according to an embodiment. As shown in FIG. 1C, the barrier 100 exhibits a relatively more compact size when the barrier 100 is in the collapsed state than when the barrier 100 in the expanded state. The relatively more compact size of the barrier 100 when the barrier 100 is in the collapsed state can facilitate storage and transportation of the barrier 100. For example, the barrier 100 can exhibit a size and shape that allows the barrier 100 to be stored in a trunk of a car when the barrier 100 is in the collapsed state. In another example, the barrier 100 can exhibit a size and shape that allows the barrier 100 to be carried like a backpack or a suitcase when the barrier 100 is in the collapsed state.

Switching the barrier 100 from the expanded state to the collapsed state can include decreasing at least one of a length, width, or thickness of the barrier 100. Similarly, switching the barrier 100 from the collapsed state to the expanded state can include increasing at least one of the length, width, or thickness of the barrier 100. For example, referring to FIGS. 1A-1B, the barrier 100 exhibits a first length $L_1$, a first width $W_1$, and a first thickness $t_1$ when the barrier 100 is in the expanded state. Meanwhile, referring to FIG. 1C, the barrier 100 exhibits a second length $L_2$, a second width $W_2$, and a second thickness $t_2$ when the barrier 100 is in the collapsed state, wherein at least one of the second length $L_2$, the second width $W_2$, or the second thickness $t_2$ is less than at least one of the first length $L_1$, the first width $W_1$, or the first thickness $t_1$, respectively.

In an embodiment, switching the barrier 100 from the expanded state to the collapsed state can include decreasing the volume occupied by the barrier 100. For example, the volume of the barrier 100 in the expanded state can be defined by a box having dimensions equal to the first length $L_1$, the first width $W_1$, and the first thickness $t_1$. Similarly, the volume of the barrier 100 in the collapsed state can be defined by a box having dimensions equal to the second length $L_2$, the second width $W_2$, and the second thickness $t_2$. In such an example, the volume of the barrier 100 in the collapsed state is less than the volume of the barrier 100 in the expanded state. In another embodiment, switching the barrier 100 from the expanded state to the collapsed state can include increasing the volume occupied by the barrier 100. For example, the barrier 100 can form a substantially planar shape when the barrier 100 is in the expanded state which can cause the barrier 100 in the expanded state to occupy a smaller volume than the barrier 100 in the collapsed state.

The barriers disclosed herein can exhibit a number of different origami patterns that can create a barrier that is at least one of thick-foldable, can fold up compactly, and can be expanded into a large barrier (e.g., a curved barrier). For example, the barrier 100 shown in FIGS. 1A-1C exhibits a 6-story modified Yoshimura pattern. FIGS. 2A-2D are plan views of barriers 200*a-d* that are in a planar configuration (e.g., are fully expanded) and that exhibit different Yoshimura or modified Yoshimura patterns, according to different embodiments. Except as otherwise disclosed herein, the barriers 200*a-d* are the same as or substantially similar to the barrier 100 of FIGS. 1A-1C. For example, each of the barriers 200*a-d* includes a continuous sheet 202, a plurality of rigid sections 206, and a plurality of hinges 208. Additionally, each of the barriers 200*a-d* are configured to switch between an at least partially expanded state to an at least partially collapsed configuration.

Figure 2A:
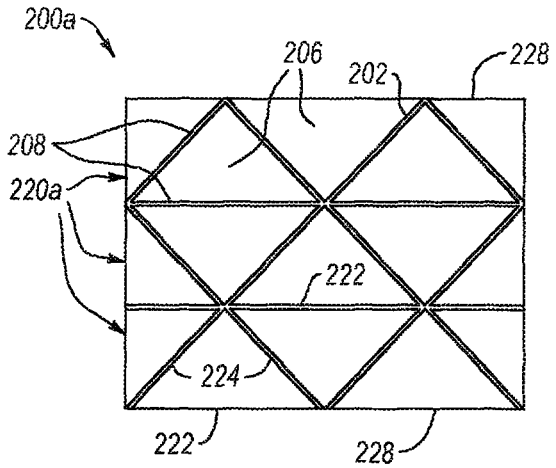
FIGS. 2A-2D are plan views of barriers that are in a planar configuration (e.g., are fully expanded) and that exhibit different Yoshimura or modified Yoshimura patterns, according to different embodiments.
Figure 2B:
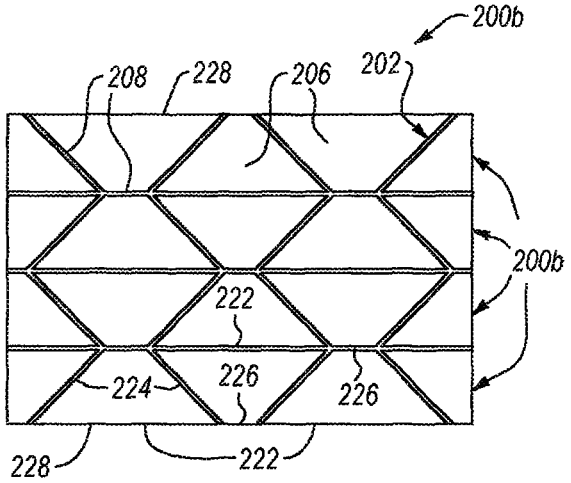
Figure 2C:
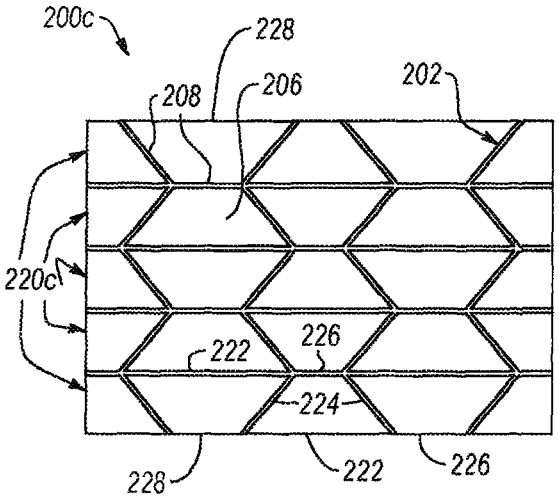
Figure 2D:
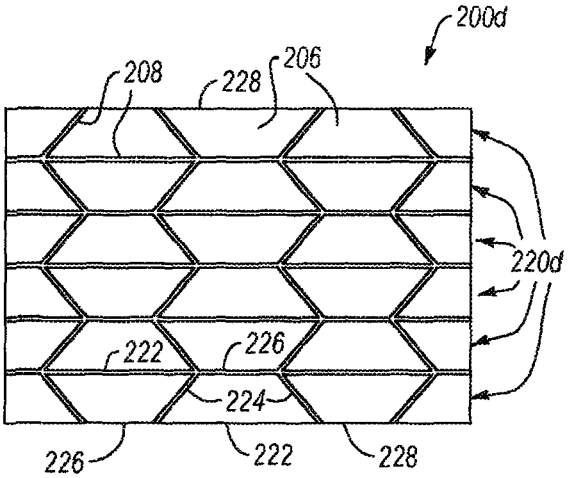

FIG. 2A illustrates a barrier 200*a* that exhibits a Yoshimura pattern that is composed of degree-6 vertices, according to an embodiment. FIGS. 2B-2D illustrate barriers 200*b-d* that each exhibit a modified Yoshimura pattern, according to an embodiment. Barriers 200*b-d* exhibit a modified Yoshimura pattern because each degree-6 vertex of a conventional Yoshimura pattern is split into two degree-4 vertices. The modified Yoshimura patterns shown in FIGS. 2B-2D are also known as a version of the Huffman pattern and/or a version of an origami pattern used by magicians known as the Troublewit. It is noted that, in an embodiment, the barrier 200*a* can exhibit a modified Yoshimura pattern and/or the barriers 200*b-d* can exhibit a Yoshimura pattern.

FIGS. 2A-2D illustrate that the barriers 200*a-d* that exhibit a Yoshimura or a modified Yoshimura pattern can include a number of stories. "Stories" are defined as the number of rigid sections 206 in the vertical direction of the barriers 200*a-d*. Each of the stories of the barriers 200*a-d* can include a generally horizontal hinges 208 that separates each of the stories. For example, FIG. 2A illustrates that the barrier 200*a* includes three stores 220*a*, FIG. 2B illustrates that the barrier 200*b* includes four stories 220*a*, FIG. 2C illustrates that the barrier 200*c* includes five stories 220*c*, and FIG. 2D illustrates that the barrier 200*d* includes six stories 220*d*. While it is possible to have a Yoshimura or a modified Yoshimura pattern having an infinite amount of stories, for practical reasons, such as manufacturing, it is advantageous to limit the Yoshimura or a modified Yoshimura patterns to 3 to 10 stories, and more particularly, to 3 to 6 stories.

The number of stories of the Yoshimura or a modified Yoshimura pattern used to form the barriers 200*a-d* can also affect the stability of the barriers 200*a-d* when expanded for several reasons. First, increasing the number of stories of the barriers 200*a-d* can increase the stability of the barriers 200*a-d* because it can increase the width of the barriers 200*a-d*. For example, the wider footprint of the 6-story barrier 202*d* provides better resistance to tipping than the 5-story barrier 202*c*, the 4-story barrier 202*b*, and the 3-story barrier 202*a*. Second, the structural stability of the barriers 200*a-d* can also be increased by increasing the number of stories of the barriers 200*a-d* because parallel axes of the hinges 208 become less collinear. For example, the angled hinges 208 on the 4-story barrier 202*b* are closer to being collinear than those on the 6-story barrier 202*d*. The closer the hinges 208 are to being collinear, the more diagonal sheering can occur. Third, increasing the number of stories of the barriers 200*a-d* can result in more hinges 208, which can decrease stability of the barriers 200*a-d*. For example, increasing the number of stories above a certain number (e.g., greater than 8 stories, greater than 10 stories, greater than 15 stories, or greater than 20 stories) can decrease the stability of a barrier even though the barrier exhibits an increased width and non-collinear hinges. In view of the above, the inventors have found that the 6-story barrier 202*d* provides enough stories to have a stable base, and fewer collinear hinges 208, and not too many hinges 208. As such, it is currently believed by the inventors that the 6-story barrier 202*d* may result in a universal barrier that works the same in both directions and helps reduce set up time and eliminates set up error in critical situations.

The number of stories of the Yoshimura or a modified Yoshimura pattern that is used to form the barriers 200*a-d* can also determine the storage efficiency and storage size of the barriers 200*a-d* when the barriers 200*a-d* are in a collapsed state. In particular, increasing the number of stories of the Yoshimura or a modified Yoshimura pattern increases the unused space in the middle of the folded Yoshimura or a modified Yoshimura pattern and increases size and number of the gaps between the folded layers of the Yoshimura or a modified Yoshimura pattern. For example, the barrier 200*a* of FIG. 2A exhibits better storage efficiency and storage size than the barriers 200*b-d* of FIGS. 2B-2D. However, increasing the number of stories of the Yoshimura or a modified Yoshimura pattern can decrease a collapsed base dimensions of the barriers 200*a-d* (e.g., the second width $W_2$ and the second thickness $t_2$ shown in FIG. 1C) and increases a length of the barriers 200*a-d* (e.g., the second length $L_2$ shown in FIG. 1C) when the barriers 200*a-d* are in a collapsed state. For example, the 6-story barrier 202*d* shown in FIG. 2D has smaller collapsed base dimensions and larger storage height than the 4-story barrier 202*b* shown in FIG. 2B.

FIGS. 2A-2D illustrate that the rigid sections 206 can exhibit a shape that exhibits a long edge 222 and two angular edges 224 that extend from the long edge 222 at an oblique angle. For example, as shown in FIG. 2A, the rigid sections 206 can exhibit a generally triangular shape. In such an example, the two angular edges 224 intersect with each other. In another example, as shown in FIGS. 2B-2D, the rigid sections 206 can exhibit a generally trapezoidal shape. In such an example, the rigid sections 206 exhibit a short edge 226 that opposes the long edge 222 and the angular edges 224 extend between the long edge 222 and the short edge 226. The short edge 226 can be substantially parallel to the long edge 222. It is noted that rigid sections 206 exhibiting a generally trapezoidal shape can form hinges 208 that are less collinear than rigid sections 206 exhibiting a generally triangular shape.

Each of the barriers 200*a-d* includes two opposing surfaces 228 that are configured to contact a support surface (e.g., ground, floor, etc.) when the barriers 200*a*-200*d* are in the expanded state. The two opposing surfaces 228 can be defined by or positioned proximate to some of the long edges 222 of the rigid sections 206. The two opposing surfaces 228 can also be defined by or positioned proximate to the intersection of the two angular edges 224 when the rigid sections 206 exhibit a generally triangular shape or by the short edge 226 when the rigid sections 206 exhibit a generally trapezoidal shape. Increasing the number of long edges 222 that form the opposing surface 228 that contacts the support surface increases the stability of the barriers 200*a-d* when the barriers 200*a-d* the expanded state. For example, an opposing surface 228 that is formed from two long edges 222 is more stable than an opposing surface 228 that is formed from a single long edge 222.

The barriers 200*a-d* can have an odd number of stories or an even number of stories. However, a Yoshimura or a modified Yoshimura pattern that exhibits an even number of stories may exhibit improve the stability and facilitate quicker deployment than a Yoshimura or a modified Yoshimura pattern that exhibit an odd number of stories. For example, barriers 200*a* and 200*c* of FIGS. 2A and 2C exhibit an odd number of stories. Forming the barriers 200*a* and 200*c* from an odd number of stories can cause the two opposing surfaces 228 thereof to be defined by or proximate to a different number of long edges 222, intersections of the angular edges 224, or the short edges 226. As such, one of the two opposing surfaces 228 of the barriers 200*a* and 200*c* can be more stable when contacting the support surface than the other of the two opposing surfaces 228. Therefore, an operator of the barriers 200*a* and 200*c* may need to be aware of which opposing surface 228 contacts the support surface to maximize the stability of the barriers 200*a* and 200*c*. Meanwhile, the barriers 200*b* and 200*d* of FIGS. 2B and 2D exhibit an even number of stories. Forming the barriers 200*b* and 200*d* from an even number of stories causes the two opposing surfaces 228 thereof to be defined by or proximate to the same number of long edges 222, intersections of the angular edges 224, or the short edges 226. As such, both of the two opposing surfaces 228 of the barriers 200*b* and 200*d* are equally stable when contacting the support surface. Therefore, an operator of the barriers 200*b* and 200*d* does not need to check which of the two opposing surfaces 228 contacts the support surface thereby facilitating deployment of the barriers 200*b* and 200*d*.

Forming the barriers 200*a-d* using the Yoshimura or a modified Yoshimura pattern causes the barriers 200*a-d* to only exhibit a single degree of freedom, which provides additional control while deploying the barriers 200*a-d*. The additional control in deploying the barriers 200*a-d* can also decrease the time required to deploy the barriers 200*a-d*. Additionally, forming the barriers 200*a-d* using the Yoshimura or a modified Yoshimura pattern can enable the rigid sections 206 of the barriers 200*a-d* to exhibit flat-edge geometry (e.g., the long or short edges 222, 226) which increases the stability of the barriers 200*a-d* compared to a barrier that does not include a flat-edge geometry.

While FIGS. 2A-2D illustrate that the barriers 200*a-d* are formed using a Yoshimura or a modified Yoshimura pattern, it is noted that any of the barriers disclosed herein can also be formed using other origami patterns. For example, any of the barriers disclosed herein can exhibit a Miura-ori pattern. Barriers exhibiting a Miura-ori pattern can fold more compactly than barriers exhibiting a Yoshimura or a modified Yoshimura pattern. Barriers exhibiting a Miura-ori pattern may require the use of offsets or other features that account for the thickness of layers stacking inside of each other. In another example, any of the barriers disclosed herein can exhibit a square twist pattern which can have similar benefits as the Miura-ori pattern. In another example, any of the barriers disclosed herein can exhibit a diamond pattern. Barriers exhibiting a diamond pattern can exhibit semicircular shapes while in their intermediate states (e.g., a state between the collapsed and expanded states) and can fold more compactly than similar barriers exhibiting a Yoshimura or a modified Yoshimura pattern. Additionally, barriers that exhibit a diamond pattern can exhibit more than a single degree of freedom while switching the barriers between the expanded and collapsed states.

In an embodiment, any of the continuous sheets disclosed herein can be completely planar (e.g., exhibit no protrusions or intrusions). However, a continuous sheet that is completely planar can have problems folding and unfolding, especially when the continuous sheet exhibits a non-negligible thickness. For example, the completely planar continuous sheet can form a hinge having a mountain side and a valley side. Folding the completely planar continuous sheet can put portions of the completely planar continuous sheet that is at or near the mountain side of the hinge to be in tension and the portions of the completely planar continuous sheet that is at or near the valley side in compression. Causing portions of the completely planar continuous sheet to be in tension can cause the completely planar continuous sheet to tear. Additionally, compressing portions of the completely planar continuous sheet can cause the completely continuous sheet to crease which can weaken the continuous sheet. Additionally, causing portions of the completely planar sheet to be in tension and/or compression can make compactly folding the substantially planar continuous sheet difficult.

Figure 3A:
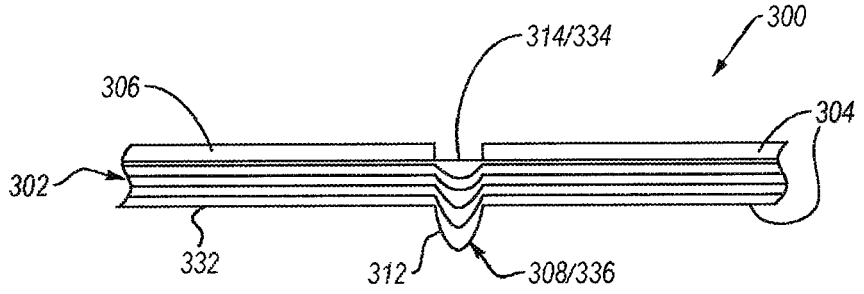
FIGS. 3A-3C are partial cross-sectional views of a portion of a barrier that includes a hinge exhibiting a thick membrane fold when the hinge is completely unfold, partially folded, and completely folded, respectively, according to embodiment.
Figure 3B:
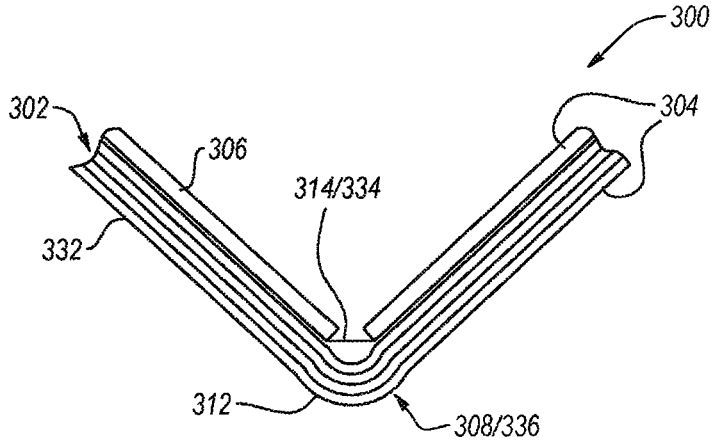
Figure 3C:
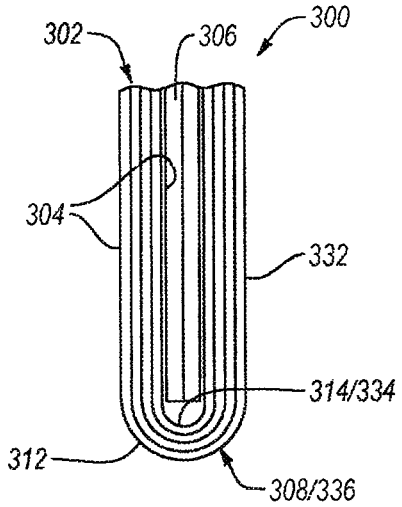

As such, in some embodiments, the barriers disclosed herein can include continuous sheets that are configured to reduce the tension and compression forces in the continuous sheets, especially if the continuous sheet exhibits a non-negligible thickness. In particular, the fold lines of the continuous sheet that act as hinges can be configured to accommodate the thickness of the continuous sheet. For example, the hinges can exhibit a thick membrane fold (e.g., turn-of-cloth fold). FIGS. 3A-3C are partial cross-sectional views of a portion of a barrier 300 that includes a hinge 308 exhibiting a thick membrane fold when the hinge 308 is completely unfold, partially folded, and completely folded, respectively, according to embodiment. Except as otherwise disclosed herein, the barrier 300 can be the same as or similar to any of the barriers disclosed herein. For example, the barrier 300 can include a continuous sheet 302 that forms the hinge 308 and a plurality of rigid sections 306. Additionally, the barrier 300, and in particular the hinge 308, can be used in any of the barrier embodiments disclosed herein.

To form the thick membrane fold, the continuous sheet 302 is formed from a plurality of layers, such as from at least a first layer 332 and a second layer 334 that opposes the first layer 332. The first layer 332 defines the mountain side 312 of the hinge 308 and one of the two exterior surface 304 of the continuous sheet 302. Similarly, the second layer 334 defines the valley side 314 of the hinge 308 and the other of the two exterior surfaces 304 of the continuous sheet 302. The first layer 332 includes extra material at or near the mountain side 312 of the hinge 308 whereas the second layer 334 does not include extra material. In an example, the continuous sheet 302 also includes one or more additional layers between the first and second layers 332, 334. In such an example, the one or more addition layers can also include extra material. However, the amount of extra material that each of the one or more additional layers have generally decreases from the first layer 332 to the second layer 334.

Referring to FIG. 3A, the extra material of the first layer 332 and, optionally, the one or more additional layers bunches up when the hinge 308 is unfolded. The bunching up of the extra material can form a protrusion 336 on the mountain side 312 of the hinge 308. Meanwhile, the second layer 334 is substantially planar. The presence of the protrusion 336 on the mountain side 312 and the substantially planar second layer 334 can bias the hinge 308 to fold in a certain direction. FIGS. 3B and 3C illustrate how the extra material of the first layer 332 and, optionally, the one or more additional layers allows the hinge 308 to be folded without causing the first layer 332 to be in tension and the second layer 334 to be compressed. As such, the extra material of the first layer 332 and, optionally, the one or more additional layers can be used to increase the flexibility of the hinge 308 and allowing the hinge 308 to be completely unfolded and completely folded regardless of the thickness or number of layers used to form the continuous sheet 302.

In an embodiment, the continuous sheet 302 can be configured to contain the bunching at or near the mountain side 312 of the hinge 308 and cause the protrusion 336 to extend outwardly from the mountain side 312 of the hinge 308. For example, the portions of the continuous sheet 302 adjacent to the hinges 308 can be sewn together to prevent the extra material from bunching at a location that is spaced from the hinge 308. This can result in the hinges 308 being biased. This means that the protrusion 336 may remain visible when the barrier 300 is in the expanded state.

As previously discussed, the barriers disclosed herein can be formed from a continuous sheet that includes one or more layers and a plurality of rigid sections that are attached to, disposed in, and/or reinforces the continuous sheet. FIGS. 4A-4E are partial cross-sectional views of barriers 400*a-e* that have different arrangements of one or more layers and a plurality of rigid sections, according to different embodiments. Except as otherwise disclosed herein, the barriers 400*a-e* are the same as or substantially similar to any of the barriers disclosed herein. Additionally, any of the barriers disclosed herein can have any of the arrangements illustrated in FIGS. 4A-4E.

Figure 4A:
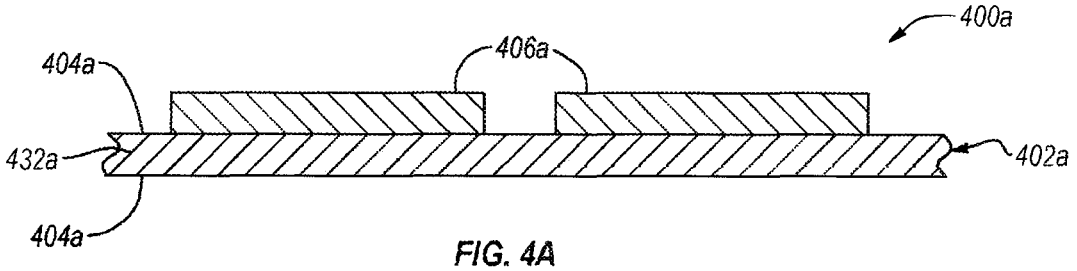
FIGS. 4A-4E are partial cross-sectional views of barriers that have different arrangements of one or more layers and a plurality of rigid sections, according to different embodiments.

Referring to FIG. 4A, the barrier 400*a* includes a continuous sheet 402*a* that includes two exterior surfaces 404*a* and a plurality of rigid sections 406*a*. The plurality of rigid sections 406*a* are attached to at least one of the two exterior surfaces 404*a* of the continuous sheet 402*a*. The continuous sheet 402*a* is formed from at least one layer 432*a*. The at least one layer 432*a* can include a single layer or a plurality of layers that are each substantially the same.

Figure 4B:
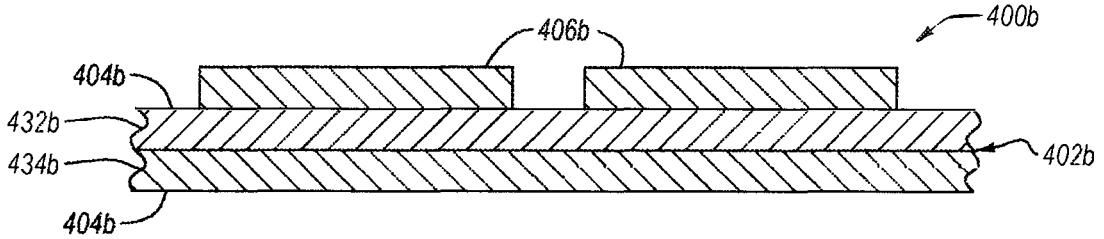

Referring to FIG. 4B, the barrier 400*b* includes a continuous sheet 402*b* that includes two exterior surfaces 404*b* and a plurality of rigid sections 406*b* that are attached to at least one of the two exterior surfaces 404*b*. The continuous sheet 402*b* is formed from at least at least one first layer 432*b* and at least one second layer 434*b* that is different than the first layer 432*b*. For example, the first layer 432*b* can exhibit a material composition, structure, etc. that is different than the second layer 434*b*.

Figure 4C:
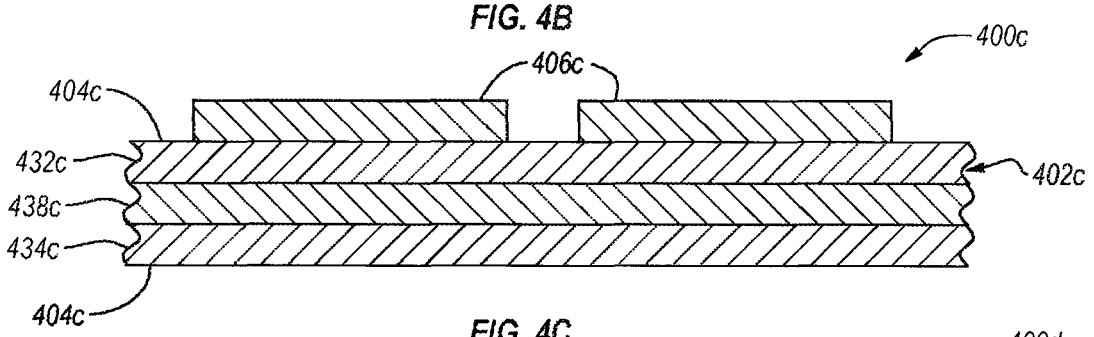

Referring to FIG. 4C, the barrier 400*c* includes a continuous sheet 402*c* that includes two exterior surfaces 404*c* and a plurality of rigid sections 406*c* that are attached to at least one of the two exterior surfaces 404*c*. The continuous sheet 402*c* is formed from at least at least one first layer 432*c*, at least one second layer 434*c*, and at least one third layer 438*c*. The third layer 438*c* is different than the first and second layers 432*c*, 434*c* and, the first and second layers 432*c*, 434*c* are substantially the same or different than each other. In an embodiment, at least one of the first or second layers 432*c*, 434*c* can form protective layers that are configured to protect the third layer 438*c*. For example, the barrier 400*c* can be a ballistic barrier and the third layer 438*c* can include Kevlar. However, Kevlar has a relatively low abrasion resistance, water resistance, and ultra-violet light resistance and, as such, exposing the third layer 438*c* to the environment can adversely affect the ballistic properties of the Kevlar. In such an example, the first and second layers 432*c*, 434*c* of the barrier 400*c* can be formed from a material that exhibits better abrasion resistance, water resistance, and/or ultra-violet light resistance than Kevlar, such a ballistic nylon. As such, the first and second layers 432*c*, 434*c* can protect the third layer 438*c* from the environment and maintain the ballistic properties of the third layer 438*c*.

Figure 4D:
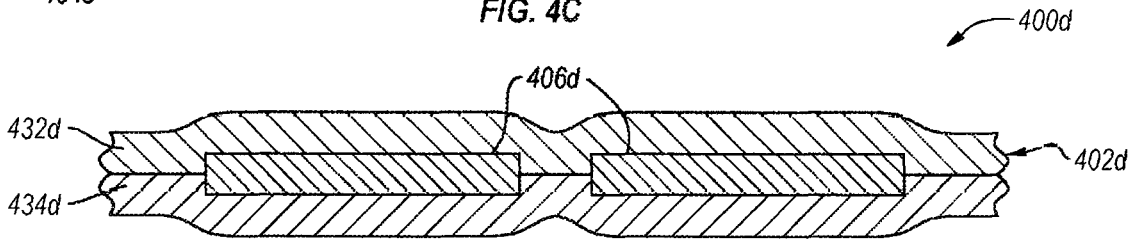

Referring to FIG. 4D, the barrier 400*d* includes a continuous sheet 402*d* and a plurality of rigid sections 406*d* that are disposed in the continuous sheet 402*d*. For example, the continuous sheet 402*d* can include at least one first layer 432*d* and at least one second layer 434*d*. The first and second layers 432*d*, 434*d* can be substantially the same or different (e.g., exhibit different material compositions). In such an example, the rigid sections 406*d* can be disposed between the first and second layers 432*d*, 434*d*. Disposing the rigid sections 406*d* in the continuous sheet 402*d* can improve the aesthetics of the barrier 400*d*, allows the first and second layers 432*d*, 434*d* to protect the rigid sections 406*d* from the environment, provide new means of securely coupling the rigid sections 406*d* to the continuous sheet 402*d*, etc.

Figure 4E:
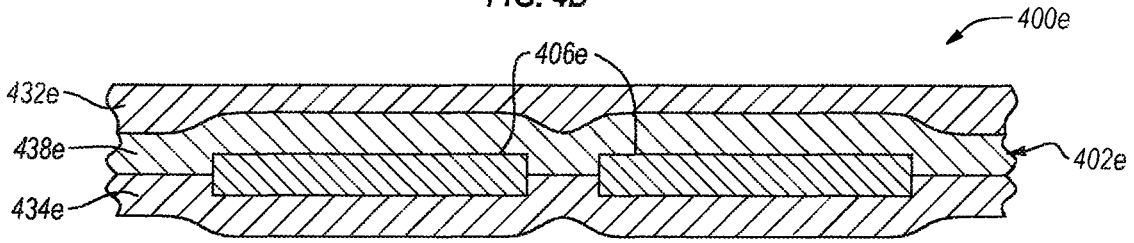

Referring to FIG. 4E, the barrier 400*e* includes a continuous sheet 402*e* and a plurality of rigid sections 406*e* that are disposed in the continuous sheet 402*e*. For example, the continuous sheet 402*e* can include at least one first layer 432*e*, at least one second layer 434*e*, and at least one third layer 438*e* that is disposed between the first and second layers 432*e*, 434*e*. Except as otherwise disclosed herein, the first, second, and third layers 432*e*, 434*e*, 438*e* can be the same or substantially similar to the first, second, and third layers 432*c*, 434*c*, 438*c* of FIG. 4C. In an example, the rigid sections 406*e* can be disposed between the third layer 438*e* and at least one of the first or second layers 432*e*, 434*e*. In another example, the rigid sections 406*e* can be disposed in the third layer 438*e* (e.g., the third layer 438*e* includes at least two layers and the rigid sections 406*e* are disposed between the at least two layers of the third layer 438*e*).

It is noted that the barriers disclosed herein can exhibit arrangements other than the arrangements illustrated in FIGS. 4A-4E. For example, the barriers disclosed herein can include at least one rigid section attached to at least one of the two exterior surfaces of the continuous sheet and at least one rigid section disposed in the continuous sheet. In another example, the barriers disclosed herein can be formed from a continuous sheet that includes at least one first layer, at least one second layer, at least one third layer, and one or more additional layers.

Figure 5:
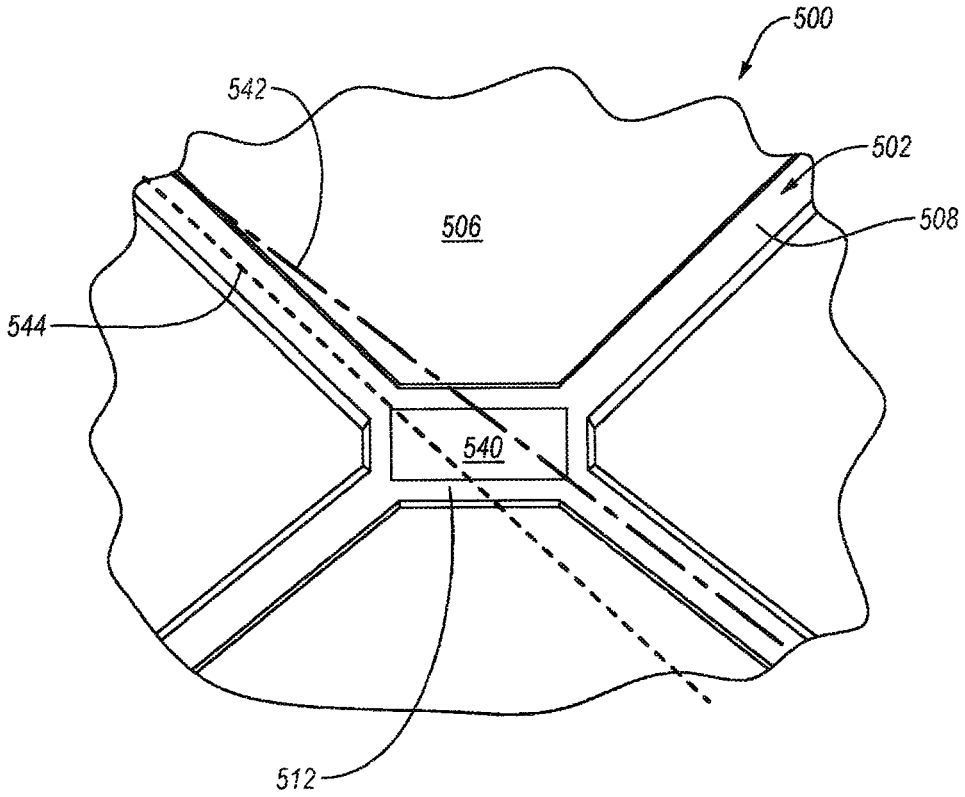
FIG. 5 is a schematic front view of a portion of a barrier illustrating several mechanisms that can be used to stabilize the barrier when the barrier is in the expanded state, according to an embodiment.

In some embodiments, the barriers disclosed herein can include one or more mechanisms that are configured to improve the stability of the barriers when the barriers are in the at least partially expanded state. FIG. 5 is a schematic front view of a portion of a barrier 500 illustrating several mechanisms that can be used to stabilize the barrier 500 when the barrier 500 is in the expanded state, according to an embodiment. Unless otherwise disclosed herein, the barrier 500 can be similar to any of the barriers disclosed herein. For example, the barrier 500 can be formed from a continuous sheet 502, a plurality of rigid sections 506, and a plurality of hinges 508. The stability mechanisms illustrated in FIG. 5 can be used in any of the barrier disclosed herein.

In an embodiment, the stability mechanisms that can be used to stabilize the barrier 500 can include at least one spacer 540. The spacer 540 includes a narrow rigid panel that is formed from any of the rigid panel materials disclosed herein. The spacer 540 is attached to portions of the continuous sheet 502 are that adjacent to gaps formed between the rigid sections 506. The spacers 540 can be configured to decrease the instability in the barrier 500 that is caused by the gaps. In an example, the spacer 540 is disposed on the mountain size 512 of the hinges 508 because the size of the gaps between the rigid sections 506 on the mountain side 512 of the hinges 508 may be greater than the gaps between the rigid sections 506 on the valley side (not shown) of the hinges 508. It is noted that the spacers 540 can also be used to strengthen weak points in the barrier 500 that are formed by the gaps.

In an embodiment, the mechanism used to increase the stability of the barrier 500 can include positioning the hinges 508 to be substantially non-collinear. The hinges 508 are substantially non-collinear when a plurality of hinges 508 intersect a single gap (e.g., an unoccupied gap or a gap that is at least partially occupied by a spacer 540) and, at most, only one pair of hinges 508 are collinear. The hinges 508 are non-collinear when the longitudinal axes thereof are not parallel and/or are offset. Positioning the hinges 508 to be substantially non-collinear can increase the stability of the barrier 500 when the barrier 500 is in the expanded state. For example, FIG. 5 illustrates a plurality of hinges 508 that meet at a single gap (e.g., the gap is at least partially occupied by the spacer 540) and that all of the hinges 508 that intersect at the gap are non-collinear. For instance, FIG. 5 illustrates a first longitudinal axis 542 of one of the hinges 508 and a second longitudinal axis 544 of another one of the hinges 508. As shown, the first longitudinal axis 542 is offset and non-parallel to the second longitudinal axis 544.

Figure 6:
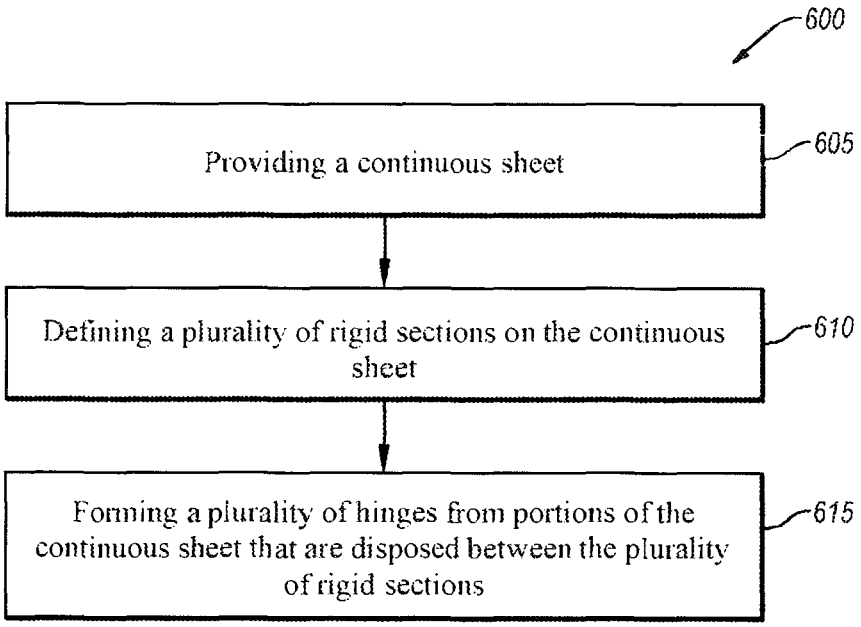
FIG. 6 is a flow chart of a method of forming any of the barriers disclosed herein, according to an embodiment.

FIG. 6 is a flow chart of a method 600 of forming any of the barriers disclosed herein, according to an embodiment. The method 600 can include blocks 605, 610, and 615. Except as otherwise disclosed herein, blocks 605-615 can be performed in any order, can be split into a plurality of different blocks, combined into a single block, supplemented, or deleted. Additionally, as discussed in more detail below, the method 600 can include one or more additional blocks.

Block 605 recites "providing a continuous sheet." In an example, block 605 includes providing a sheet that includes a single layer or a plurality of layers. In another example, block 605 can include providing a sheet that is premade. In another example, block 605 can include providing a plurality of layers and forming the plurality of layers into the continuous sheet. In another example, block 605 can include providing any of the continuous sheets disclosed herein.

In an embodiment, block 605 can include providing at least one first layer that forms one of the exterior surfaces of the continuous sheet and at least one second layer that forms another one of the exterior surfaces of the continuous sheet. In such an embodiment, block 605 can also include providing at least one third layer that is disposed between the first and second layers. In an example, at least one of the first or second layers can be configured to form protection layers that protect the third layer from the environment. In such an example, at least one of the first or second layer can exhibit at least one of an abrasion resistance, water resistance, or ultra-violet light resistance that is greater than the third layer.

Block 610 recites "defining a plurality of rigid sections on the continuous sheet." For example, block 610 can include providing any of the rigid panels disclosed herein and attaching the rigid panels to at least one of the exterior surfaces of the continuous sheet. In another example, block 610 can include providing any of the rigid panels disclosed herein and disposing the rigid panels in the continuous sheet. In another example, block 610 can include laminating at least one thermoplastic on a plurality of regions of the continuous sheet. In another example, block 610 can include impregnating a plurality of regions of the continuous sheet with at least one epoxy, resin, or another hardener. In another example, block 610 can include forming a plurality of stiches on a plurality of regions of the continuous sheet.

In an embodiment, the method 600 can include performing blocks 605 and 610 substantially simultaneously. For example, block 605 can include providing at least one first layer. After providing the at least one first layer, block 610 can include positioning a plurality of rigid panels to the one or more layers. After positioning the plurality of rigid panels on the one or more layers, block 605 can include disposing at least one second layer over the plurality of rigid panels and the first layer. Such an example can also include attaching the first and second layers together, attaching the rigid panels to the first and/or second layers, and/or attaching one or more additional layers to the first and second layers.

In an example, block 610 includes defining a plurality of rigid sections on the continuous sheet to form a Yoshimura or a modified Yoshimura pattern, a Miura-ori pattern, a square twist pattern, or a diamond pattern. In another example, block 610 can include forming a Yoshimura or a modified Yoshimura pattern exhibiting an even number of stories, such as a Yoshimura or a modified Yoshimura pattern having six stories.

Block 615 can include "forming a plurality of hinges from portions of the continuous sheet that are disposed between the plurality of rigid sections." In an example, block 615 can be performed substantially simultaneously with blocks 605 and/or 610. In an example, block 605 can include providing a continuous sheet that already includes a plurality of thick membrane folds formed therein or forming the thick membrane folds in the continuous sheet. In an example, block 615 can include forming a plurality of hinges that are substantially non-collinear.

In an example, the method 600 can include positioning at least one spacer on at least one mountain side of at least one of the plurality of hinges. In another example, the method 600 can include coupling a plurality of springs to the plurality of rigid sections. In another example, the method 600 can include positioning at least one brace to at least one of the plurality of rigid section.

The barriers disclosed herein can be modified for different applications by forming the barriers from materials that exhibit characteristics that are beneficial for specific applications or causing the barriers to exhibit a shape that provides characteristics that are beneficial for specific applications. The characteristics that are beneficial for a specific application, materials that provide the characteristics, and shapes that provide the characteristics may be known by a person having ordinary skill in the art.

In an embodiment, any of the barriers disclosed herein can be configured to be a ballistic barrier, such as a ballistic barrier that meets the same requirements as an armored vest that has an NIJ IIIa rating. Ballistic barriers solve a compelling need—protecting law enforcement, military, and innocent victims from dangerous situations. In most ballistic applications, portability is desired and quick deployment is essential. Possible applications for a ballistic barrier includes law enforcement, civilian, and military application. For example, a ballistic barrier that is configured for law enforcement applications can be configured to be a temporary barrier, be transported and stored in a small compacted state, and to be quickly expandable. In another example, ballistic barriers that are configured for military application can be less transportable and temporary than ballistic barriers that are configured for law enforcement applications since military barriers are often permanent blockades or barriers that are rated for very high power explosives or ammunition.

In an embodiment, any of the barriers disclosed herein can be construction barriers. Construction barriers include protective barriers that are configured to at least one of cover sidewalks, protect pedestrians, or to partition a construction site.

In an embodiment, any of the barriers disclosed herein can be acoustic barriers. Acoustic barriers can include sound absorbing barriers that reduce echo or amplifying barriers.

In an embodiment, any of the barriers disclosed herein can be water barriers that can be configured to prevent flooding. For example, the water barriers can be a flood gates or dams configured to redirect flood waters.

In an embodiment, any of the barriers disclosed herein can be fire/heat barriers, such as fire shelters for firefighters who become trapped in the forest fires, or barriers configured to protect important rooms in houses and buildings.

In an embodiment, any of the barriers disclosed herein can be radiation barriers that can isolate a radiation spill and protect selected areas from radiation damage.

In an embodiment, any of the barriers disclosed herein can be traffic barriers that are configured to be used for traffic stops, directing traffic, or limiting public access.

In an embodiment, any of the barriers disclosed herein can be wind barriers for locations where winds cause potentially dangerous situations.

In an embodiment, any of the barriers disclosed herein can be chemical barriers or light barriers (e.g., opaque barriers).

While various aspects and embodiments have been disclosed herein, other aspects and embodiments are contemplated. The various aspects and embodiments disclosed herein are for purposes of illustration and are not intended to be limiting.

The invention claimed is:

1. A barrier, comprising a sheet extending between two opposing surfaces;

a plurality of rigid sections attached to or incorporated into the sheet, wherein the plurality of rigid sections form a plurality of stories between the two opposing surfaces, the plurality of rigid sections defining gaps therebetween; and a plurality of hinges, each of the plurality of hinges is adjacent to a corresponding one of the gaps, the plurality of hinges formed from portions of the sheet, the plurality of hinges intersect with each other at at least one vertex, wherein at most only one pair of hinges intersecting at one vertex is collinear;

wherein the barrier is configured to be switchable between an at least partially collapsed state and an at least partially expanded state.

2. The barrier of claim 1, wherein the sheet includes a continuous sheet.

3. The barrier of claim 2, wherein the continuous sheet includes an uncut sheet.

4. The barrier of claim 1, wherein the sheet includes a discontinuous sheet.

5. The barrier of claim 4, wherein the discontinuous sheet includes one or more cuts formed therein.

6. The barrier of claim 5, wherein the one or more cuts formed in the discontinuous sheet are covered by another portion of the sheet.

7. The barrier of claim 1, wherein the sheet includes a plurality of layers.

8. The barrier of claim 7, wherein:

the plurality of layers includes at least one first layer and at least one second layer; and each of the plurality of rigid sections is disposed between the at least one first layer and the at least one second layer.

9. The barrier of claim 1, wherein the plurality of rigid sections forms an even number of stories.

10. The barrier of claim 1, wherein the plurality of rigid sections includes a plurality of rigid panels that are distinct from the sheet.

11. The barrier of claim 1, wherein each of the plurality of rigid sections includes ultra-high molecular weight polyethylene.

12. The barrier of claim 1, wherein the barrier exhibits a single degree of freedom when switching between the at least partially collapsed state and the at least partially expanded state.

13. The barrier of claim 1, wherein each of the portions of the sheet that form the plurality of hinges exhibits a thick membrane fold.

14. The barrier of claim 1, further comprising at least one of:

one or more spacers positioned on a mountain side of one or more of the plurality of hinges;

one or more springs coupled to at least one of the plurality of rigid sections; or at least one brace coupled to at least some of the plurality of rigid sections.

15. A barrier, comprising a sheet extending between two opposing surfaces;

a plurality of rigid sections attached to or incorporated into the sheet, wherein the plurality of rigid sections form a plurality of stories between the two opposing surfaces, the plurality of rigid sections defining gaps therebetween; and a plurality of hinges, each of the plurality of hinges is adjacent to a corresponding one of the gaps, the plurality of hinges formed from portions of the sheet, the plurality of hinges intersect with each other at at least one vertex, wherein some of the plurality of hinges that intersect at the at least one vertex are collinear;

wherein the barrier is configured to be switchable between an at least partially collapsed state and an at least partially expanded state.

16. A method to make a barrier, the method comprising:

providing a sheet extending between two opposing surfaces;

defining a plurality of rigid sections on the sheet, wherein the plurality of rigid sections form a plurality of stories between the two opposing surfaces, wherein the plurality of rigid sections define gaps therebetween; and forming a plurality of hinges from portions of the sheet, each of the plurality of hinges is adjacent to a corresponding one of the gaps, wherein at most only one pair of hinges intersecting at one vertex is collinear.

17. The method of claim 16, wherein providing a sheet includes providing a continuous uncut sheet.

18. The method of claim 16, wherein:

providing a sheet includes providing at least one first layer and at least one second layer, the at least one first layer and the at least one second layer forming two opposing exterior surfaces of the sheet; and defining a plurality of rigid sections on the sheet includes disposing a plurality of rigid panels between the at least one first layer and the at least one second layer.

19. The method of claim 16, wherein defining a plurality of rigid sections on the sheet includes forming an even number of stories of the plurality of rigid sections on the sheet.

20. The method of claim 16, further comprising positioning one or more spacers on a mountain side of at least one of the plurality of hinges.

* * * * *